United States Patent [19]

Wu

[11] 4,429,295

[45] Jan. 31, 1984

[54] VARIABLE IMPEDANCE CURRENT LIMITING DEVICE

[75] Inventor: Jiing-Liang Wu, Murrysville, Pa.

[73] Assignee: Electric Power Research Institute, Inc., Palo Alto, Calif.

[21] Appl. No.: 321,237

[22] Filed: Nov. 13, 1981

[51] Int. Cl.[3] ..... H01H 87/00

[52] U.S. Cl. ..... 337/119; 337/121; 337/321

[58] Field of Search ..... 337/114, 115, 116, 117, 337/118, 119, 121, 122, 306, 307, 314, 320, 321, 326

[56] References Cited

U.S. PATENT DOCUMENTS

| | | | |
|---|---|---|---|
| 3,644,860 | 2/1972 | Yamagata et al. | 337/21 |
| 3,699,489 | 10/1972 | Imajyo | 337/121 X |
| 3,806,855 | 4/1974 | Hurtle | 337/121 X |
| 3,886,511 | 5/1975 | Miyamoto et al. | 337/119 |
| 3,902,150 | 8/1975 | Wada et al. | 337/121 X |

*Primary Examiner*—George Harris

*Attorney, Agent, or Firm*—Flehr, Hohbach, Test, Albritton & Herbert

[57] ABSTRACT

A current limiting device including a housing in which a chamber is formed. A pair of spaced electrical terminals are located at opposite ends of the housing to be disposed in communication with the chamber. An electrically conductive fusible metal is disposed in the chamber to provide an electrically conductive path between the terminals. An insulating member is disposed in the chamber between opposite ends of the housing to define a flow passageway between the electrical terminals. The flow passageway may include a constricted portion that has a cross-sectional area and a length that is substantially less than the rest of the flow passageway defined by the insulating member such that with the occurrence of a fault current, vaporization of the fusible metal initially occurs in the constricted portion of the flow passageway. Expansion means are also provided for buffering the pressure rise in the chamber when the fusible metal is vaporized.

17 Claims, 9 Drawing Figures

VARIABLE IMPEDANCE CURRENT LIMITING DEVICE

The present invention relates generally to vapor state current limiting devices. More particularly, the invention is directed to a current limiting device that has high continuous current and voltage ratings, and a relatively low operating pressure and temperature.

Power networks are customarily provided with protective arrangements in the event the network is subjected to an overload or a short circuit. One protective arrangement utilizes a resettable circuit breaker which opens to interrupt the circuit upon the occurrence of of an overload or short circuit. System changes may cause the current to be interrupted to increase, subjecting the circuit breaker to destructive current magnitudes greater than the rating for which it is designed. To alleviate this problem, a current limiting device may be placed in series with the circuit breaker.

Current limiting devices may be of a non-destructive vapor state type. Such devices utilize a conductive material which is capable of carrying a predetermined amount of current without any substantial change in the material's electrical resistance or impedance. When subjected to an excessive current, the conductive material is vaporized, increasing the resistance or impedance of the material and reducing the current flow through the device. The current limiting device can therefore protect a circuit breaker, for a particular circuit, against destruction by insuring that the breaker operates within its designed current parameters.

One type of current limiting device known in the art includes a housing which supports a pair of spaced apart electrical terminals for connecting the current limiter in an electrical circuit. An electrically conductive fusible liquid metal is disposed within the housing between the spaced terminals to permit the conduction of electricity. The fusible metal, which for example may be sodium (Na) or potassium (K), is selected so that when a current overload or short circuit occurs, the fusible metal vaporizes, increasing its electrical impedance or resistance to current flow. Vaporization of the fusible metal is accompanied by a very high pressure increase in the device, as the vapor occupies substantially the same volume as did the liquid it replaced. To control vaporization and to contain the pressure increase associated with vaporization, it is known to place the fusible metal in a very fine capillary that forms a constricted, electrically conductive path through the housing of the current limiter. An example of such a device is shown in U.S. Pat. No. 3,644,860, issued Feb. 22, 1972.

Another current limiting device is shown in U.S. Pat. No. 3,806,855, issued Apr. 23, 1974. In this device, an insulating body or ceramic insert is disposed within a chamber in the device's housing to be located between spaced electrical terminals. Reservoirs of fusible metal are provided on either side of the insulating body. A plurality of current passages are defined across the insulating body to provide communication between the spaced apart terminals. These current passages are defined by a plurality of parallel, longitudinal channels or capillaries disposed peripherally about the external surface of the insert. The capillaries may have a uniform cross-sectional area, or, alternatively, they may have a bell-mouth shape wherein at either end of that capillary the cross-sectional area is slightly greater than that at the capillary's central portion. This device—like that of U.S. Pat. No. 3,644,860—may also include expansion means within the housing to accommodate the pressure increases associated with the vaporization of the fusible metal.

Current limiting devices like those described in U.S. Pat. Nos. 3,644,860 and 3,806,855, however, have certain characteristics which present problems in design and which limit the scope of their application. Namely, these devices operate at very high pressures and temperatures, and have low continuous current and voltage ratings. These drawbacks are inherently related to the role that current limiting devices play. To effectively limit the fault or short circuit current, the fusible metal in the device has to be vaporized rapidly, usually in about one millisecond. As noted heretofore, rapid vaporization is accompanied by very large pressure increases. To achieve such rapid vaporization and to mechanically contain the pressure rise associated with the vaporization, these devices either place the fusible metal in a fine capillary, U.S. Pat. No. 3,644,860, or in a plurality of very fine and parallel capillaries, U.S. Pat. No. 3,806,855. Because the fusible metal is located in these fine capillaries, a high resistance exists across the device which gives the device a low continuous current rating.

Another problem associated with placing the fusible metal in the capillaries of the prior art devices is that caused by the high current density present in the capillaries after vaporization. Particularly, the residue current, that is, the current flow after the vaporization is completed, will generate Joule heating which tends to overheat the vapor in the capillaries to such an extent that a high temperature plasma is produced. The presence of the high temperature plasma reduces the resistivity of the metal vapor and thus the applicable voltage.

To reduce the vapor temperature after vaporization, U.S. Pat. No. 3,806,855 provides a plurality of capillaries for better heat dissipation. In effect, U.S. Pat. No. 3,806,855 replaces the single capillary of U.S. Pat. No. 3,644,860 with a plurality of parallel capillaries having a total cross-sectional area roughly equal to that of the single capillary.

It is an object of the present invention to provide a variable impedance current limiting device having a high continuous current rating.

Another object of the present invention is to provide a current limiting device which operates at relatively low pressures and temperatures.

Yet another object of the present invention is to provide a current limiting device which can operate at high voltages.

Still another object of the present invention is to provide a current limiting device which has as very low impedance under normal operating conditions and which impedance increases by five or six orders of magnitude upon the occurrence of a fault.

Broadly speaking, the present invention is directed to a variable impedance current limiting device wherein the device can operate at relatively low pressures and temperatures. The device of the present invention also has high continuous current and voltage ratings.

The current limiting device of the invention comprises a housing in which a chamber is formed. A pair of spaced electrical terminals are respectively located at opposite ends of the housing to be disposed in communication with the chamber. An electrically conductive fusible metal is disposed in the chamber to provide an electrically conductive path between the terminals. An insulating member is disposed in the chamber between opposite ends of the housing to define with the interior wall of the housing a flow passageway that provides communication across the chamber and thus between the electrical terminals. The flow passageway includes a constricted portion that has a cross-sectional area and a length that is substantially less than that of the rest of the flow passageway defined by the member such that with the occurrence of an overload current, vaporization of the fusible metal initially occurs in the constricted portion of the flow passageway. The housing also includes expansion means for buffering the pressure rise in the chamber when the fusible metal is vaporized.

In a second embodiment of the present invention, the constricted portion of the flow passageway extends substantially through the center of the insulating member. Yet another embodiment of the present invention would have a flow passageway extending through the center of the insulating member with the diameter of the flow passageway being approximately equal to its length.

The current limiting device of the present invention will be described in more detail hereinafter in conjunction with the drawings wherein.

Figures 1, 2, 3:
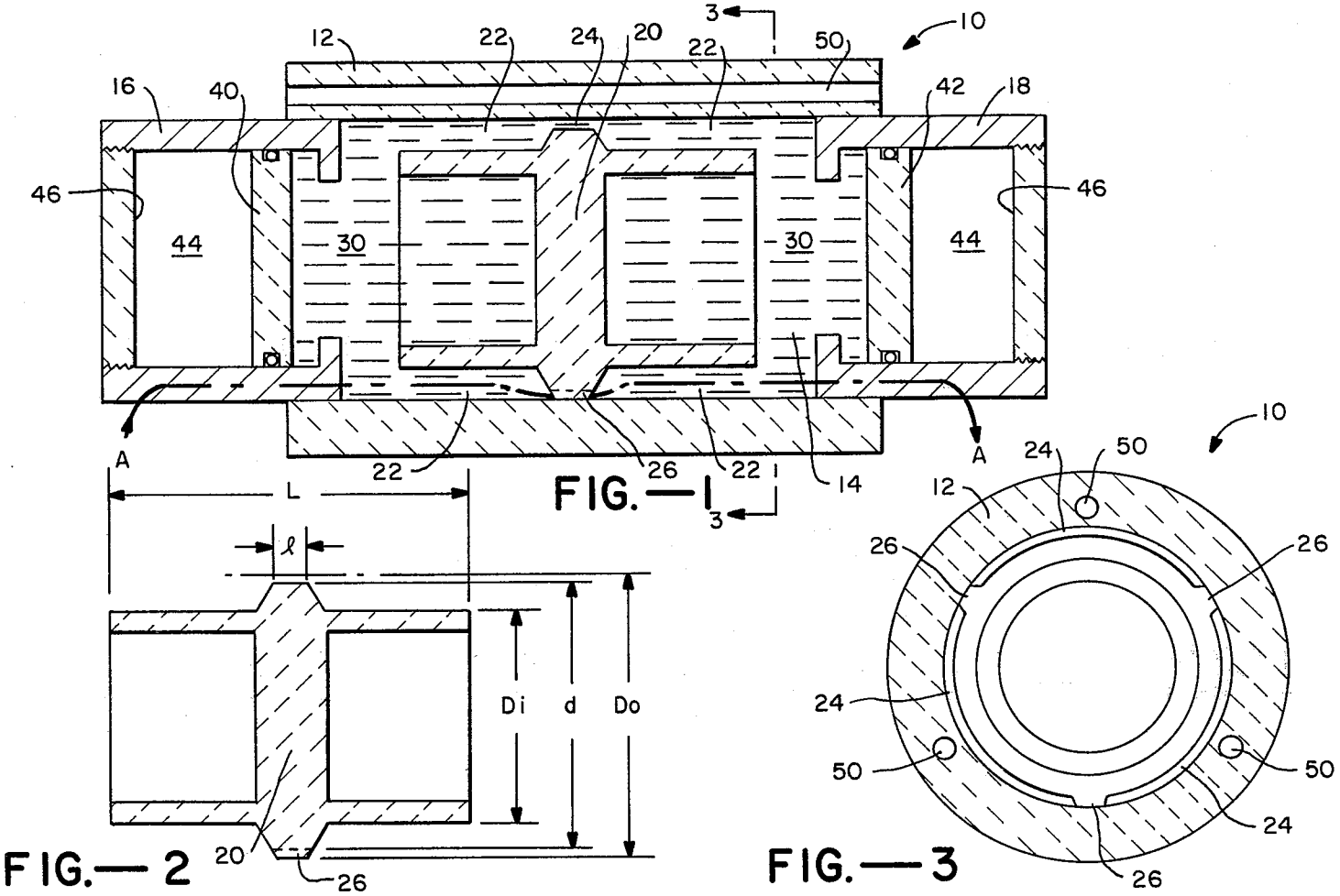
FIG. 1 is a longitudinal view of a current limiting device constructed in accordance with one embodiment of the present invention.
FIG. 2 is an enlarged longitudinal view of the insulating member that is disposed in the chamber of the device to provide a flow passageway thereacross.
FIG. 3 is a view along line 3—3 of FIG. 1.

Referring now to the drawings, attention is first directed to FIG. 1 which shows a variable impedance current limiting device 10 of the present invention. Current limiter 10 comprises a substantially tubular housing 12 in which a chamber 14 is defined. Housing 12 is preferably made of a ceramic material, such as alumina. A pair of cylindrical, electrical terminals 16 and 18 are respectively located at opposite ends of housing 12 to be disposed in communication with chamber 14. The terminals are joined and supported by housing 12. The terminals are adapted to connect the current limiting device 10 in a circuit for which the device is to provide current overload protection. It will be appreciated that suitable end caps, not illustrated, appropriately joined to housing 10 complete the housing and serve to insulatively mount terminals 16 and 18.

An insulating member 20 is disposed in the chamber between opposite ends of the housing to define a flow passageway 22 that provides communication between terminals 16 and 18. Member 20, like housing 12, is made of a ceramic material, such as alumina. Member 20 is cylindrical in shape and is concentrically arranged in housing 10. Member 20 thus defines an annular flow passageway 22 intermediate of itself and of the interior insulating wall of housing 12.

As shown in FIGS. 1 and 3, flow passageway 22 includes a constricted annular portion 24. Flow passageway 22, including constricted portion 24, provides communication between terminals 16 and 18 across chamber 24.

An electrically conductive fusible metal 30 is disposed in chamber 14 on either side of member 20, as well as in flow passageway 22, to provide an electrically conductive path between the terminals 16 and 18. The electrically conductive path goes through flow passageway 22, including constricted portion 24, as illustrated by line A—A in FIG. 1. Member 20 forms reservoirs of fusible metal 30 at opposite ends of housing 12. The fusible metal may be any one of a number of liquid metals whose resistivity increases by several orders of magnitude upon vaporization, for example, sodium (Na), potassium (K), or alloys thereof may be used.

Current limiting device 10 further includes expansion means for buffering or modulating the pressure rise in chamber 14 that occurs when the fusible metal is vaporized. The expansion means are preferably a pair of pistons 40 and 42 located at opposite ends of housing 12. The pistons are disposed within an open end of the respective electrical terminals for axial movement along the length thereof to provide means by which the expanding volumes of vaporizing fusible metal may be accommodated. An inert gas 44, or alternatively a spring means, which is not illustrate, may be disposed in the space between the pistons and the interior face 46 of the respective terminals. Besides accommodating the pressure rise associated with vaporization of the fusible metal, the expansion means can be used to control the initial pressure within housing 12 which will typically be a few atmospheres. Pistons 40 and 42 will also be constructed of a ceramic material.

Normally, heat generated by the flow of current through the device will be dissipated through the wall of ceramic housing 12 and through terminals 16 and 18. This will occur by free convection heat transfer to the ambient air. The device could also be provided with means for forced cooling. For example, device 10 could be provided with appropriate passages 50 in housing 12 for the flow of a cooling medium therethrough.

Ceramic insert or member 20 of device 10 is shown in greater detail in FIG. 2. As can be seen, spokes 26 are formed on the circumference of member 20 at its midsection, see also FIG. 3. Spokes 26 are used to align member 20 within the housing. The outside diameter $D_o$ of spokes 26 is approximately equal to that of the inner diameter of housing 12 so that the spokes fit snugly against the inner wall of the housing.

From FIG. 2, it can be seen that the diameter of flow passageway 22 is equal to:

$$(D_o - D_i)/2.$$

The diameter of the constricted portion 24 of flow passageway 22 is equal to:

$$(D_o - d)/2.$$

The length of flow passageway 22 is "L" and the length of the constricted portion 24 of the flow passageway is "l". The cross-sectional area of constricted portion 24 is substantially less than the cross-sectional area of the rest of flow passageway 22. Likewise, the length of constricted portion 24 is substantially less than that of the rest of flow passageway 22.

By a proper choice of the relevant dimensions of member 20, the impedance of device 10 under normal operating conditions can be minimized. This in turn will enable the device to have high continuous current and voltage ratings. For example, for a current limiting device to be used in a generator circuit, the dimensions of member 20 may be as follows:

L=25 centimeters,
l=0.79 centimeters,
$D_i$=15.67 centimeters
d=19.88 centimeters
$D_o$=20 centimeters.

When this type of device is filled with sodium as a fusible metal, the resistance between the electrical terminals is about 4 micro-ohms. At this resistance, the device has a very high continuous current rating. And although the cross-sectional area of constricted portion 24 is very small, its length is also small. Thus, the resistance or impedance across the electrical terminals is not as large as in current limiting devices used heretofore.

Generally, for the device of the present invention to have high continuous current and voltage ratings, to have a very low impedance under normal operating conditions, to have a very high impedance when a fault occurs, and to operate at relatively low pressures and temperatures, the ratio of the length of constricted portion 24 to that of the rest of flow passageway 22 should be between about 0.02 and 0.05. And the ratio of the cross-sectional area of constricted portion 24 to that of the rest of flow passageway 22 should be between about 0.02 and 0.05. Preferably, the length ratio is approximately 0.03, and the cross-sectional area ratio is about 0.03.

Under normal operating conditions, the Joule heating generated by the current flowing through the device of the present invention is dissipated through the wall of ceramic housing 12 and through terminals 16 and 18. When current increases suddenly as a result of a short circuit, the steady state condition is broken and fusible metal 30 in passageway 22 between housing 12 and insert 20 is heated up. The heating of the fusible metal is not uniform. At the constricted portion 24, where the current density is much higher than in the rest of passageway 22, the temperature of the fusible metal increases rapidly and reaches its vaporization temperature when the rest of the fusible metal is essentially still at its normal temperature. The time at which vaporization is initiated in constricted portion 24 is a function of the cross-sectional area of the constricted portion. This dimension, of course, can be chosen to suit the particular application of current limiting device 10.

Figure 4A:
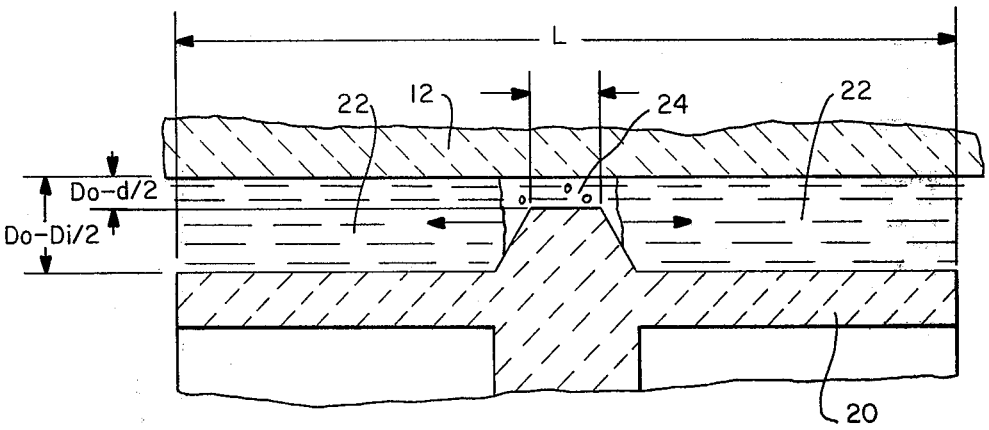
FIGS. 4A through 4C illustrate vaporization of the fusible metal in the current limiting device of the present invention.
Figure 4B:
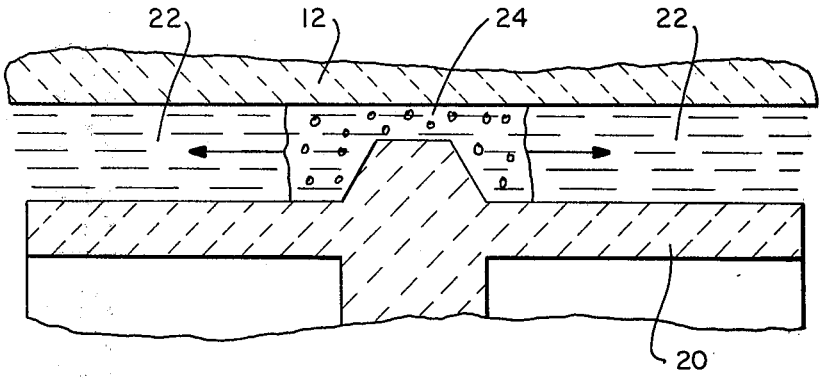
Figure 4C:
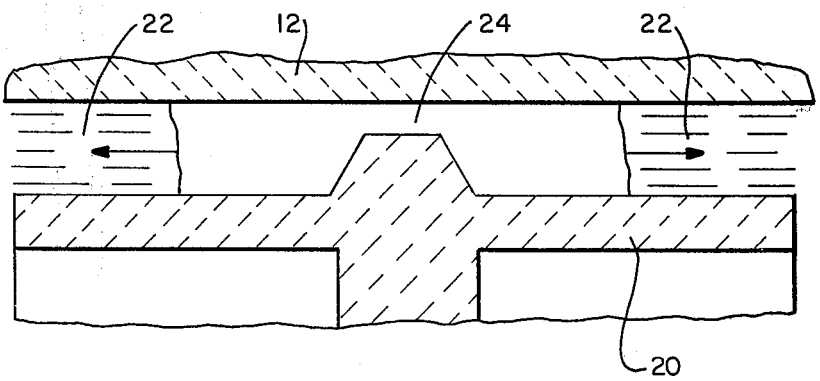

The vaporization of the fusible metal in device 10, as illustrated in FIGS. 4A–4C, is initiated in constricted portion 24. From constricted portion 24, vaporization expands toward both ends of flow passageway 22. As vaporization increases the liquid fusible metal forces pistons 40 and 42 to move, which relieves the pressure rise in chamber 14. Because the cross-sectional area of constricted portion 24 is substantially less than that of the rest of flow passageway 22, the liquid fusible metal in the non-constricted portion of flow passageway 22 only has to move a very short distance to accommodate the volume expansion due to vaporization. Since the pressure increase due to vaporization is a function of the force required for displacing the fusible metal in the non-constricted portion of passageway 22, it can be expected that for the device of the present invention the pressure rise would be much less than that in prior art devices. With current limiter 10, it would be possible to keep the pressure rise below 500 psi.

When a fault occurs, the impedance across current limiting device 10 starts to increase as soon as the temperature of the fusible metal increases. About one order of magnitude increase in the impedance can be expected before the fusible metal actually begins to vaporize. The impedance across constricted portion 24 increases very rapidly during the vaporization phase as a result of the growth of vapor bubbles, which reduce the cross-sectional area occupied by the liquid state of the fusible metal. This is because the electrical conductivity of the fusible metal vapor is negligible compared to that of liquid fusible metal. For example, the value of electrical conductivity of potassium vapor at 1200° C. and at at 10 atmospheres is about $10^{-5}$ mho/cm, which is nine orders of magnitude smaller than that of liquid potassium at its boiling point. By proper control of the pressure, the impedance across the device at the completion of vaporization can be increased by five or six orders of magnitude from its normal operating value.

After vaporization is completed and the fault current is reduced, the residue current will continue to heat the vapor, and the zone of vaporization will continue to expand. The temperature of the fusible metal vapor in constricted portion 24 and the portions of flow passageway 22 adjacent passageway 24 may reach such a value that local arcing occurs reducing the imedpance in constricted portion 24. Away from constricted portion 24, however, the vapor temperature is expected to remain relatively low because of its much lower current density. Therefore, arcing would not be expected to occur and the expanding low temperature vapor zones will sustain the high impedance of the device until the residue current is removed from the circuit. After a period of time, the fusible metal vapor will be condensed by heat dissipation and by compression of the pistons. The fusible metal will then return to its normal low impedance liquid state.

Figure 5:
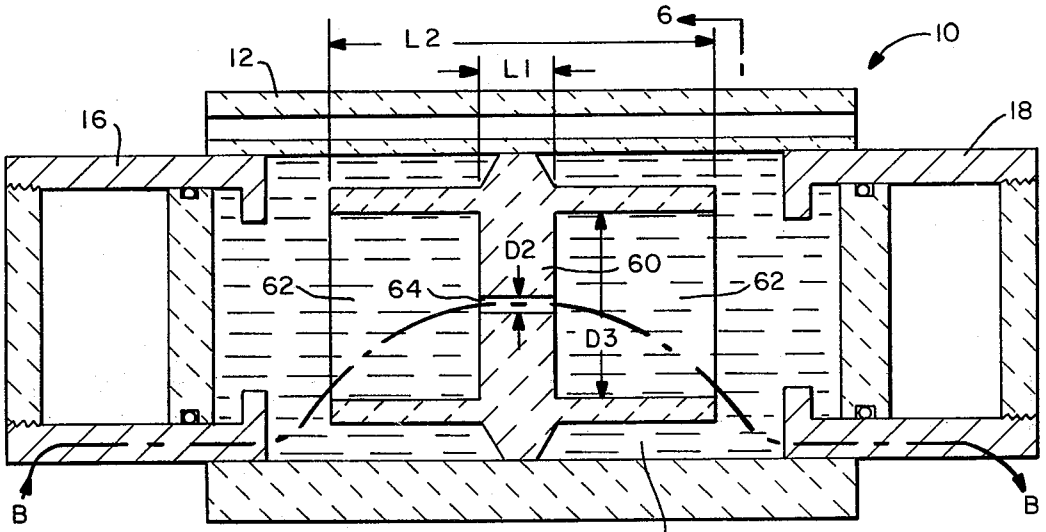
FIG. 5 is a longitudinal view of a current limiting device illustrating another embodiment of the present invention.
Figure 6:
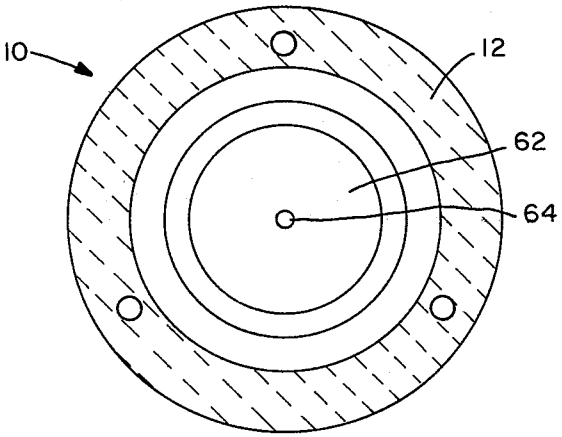
FIG. 6 is a view along line 6—6 of FIG. 5.

An alternate embodiment of the current limiting device of the present invention is shown in FIGS. 5 and 6. This embodiment is similar to the embodiment previously described but differs from that embodiment in the configuration of the flow passageway defined by the insulating member. In this embodiment, an insulating member 60 is disposed in chamber 14 between opposite ends of housing 12 to define flow passageway 62 that provides communication between terminals 16 and 18. Member 60 is cylindrical in shape and is concentrically arranged in housing 10. As shown, flow passageway 62 includes a constricted portion 64 that is axially centered in member 60. The electrically conductive path of this device goes through flow passageway 62 including constricted portion 64 as illustrated by line B—B in FIG. 5. This electrically conductive path creates a magnetic pinch effect in the region of constricted portion 64. This effect compresses and reduces the amount of fusible metal in the constricted portion 64 and thus speeds up the vaporization process of the fusible metal.

The diameter $D_2$ of constricted portion 64 of flow passageway 62 is substantially less than the diameter $D_3$ of the non-constricted portion of the flow passageway, and thus the cross-sectional area of the non-constricted portion of the flow passageway is substantially greater than that of the constricted portion. As illustrated, the length of the constricted portion of the flow passageway may be substantially less than that of the rest of the flow passageway. The length of constricted portion 64 of flow passageway 62 may also be approximately equal to the length $(L_2-L_1)$ of the nonconstricted portion of the flow passageway. In this embodiment, the ratio of the length $L_1$ of constricted portion 64 so that of the rest of the flow passageway 62 should be between about 0.1 and 0.2. And the ratio of the cross-sectional area of constricted portion 64 to that of the rest of the flow passageway 62 should be between about 0.1 and 0.2. Preferably, the length ratio is approximately 0.15 and the cross-sectional area ratio is about 0.15.

Figure 7:
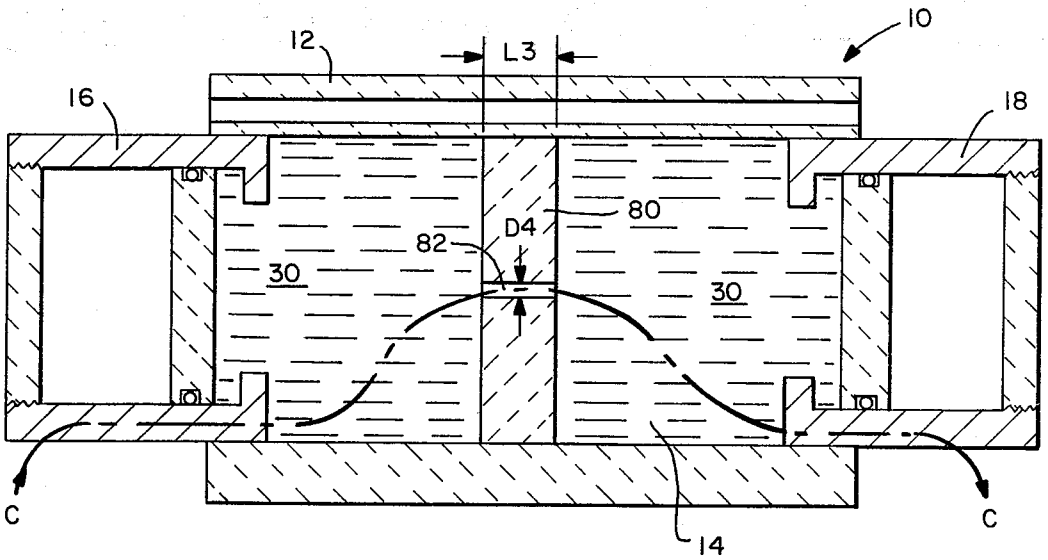
FIG. 7 is a longitudinal view of a current limiting device illustrating yet another embodiment of the present invention.

Another embodiment of the present invention is shown in FIG. 7. In this embodiment, insulating member 80 comprises a cylindrical disk that is centered within housing 12. Member 80 has flow passageway 82 extending through the center thereof. Link C—C represents the electrically conductive path of this embodiment. The diameter $D_4$ of flow passageway 82 is approximately equal to the length $L_3$ of the flow passageway. With the occurrence of an overload current, vaporization of the fusible metal initially occurs in flow passageway 82.

Although the invention has been described with reference to specific embodiments, the description is illustrative of the invention and is not to be construed as limiting the invention. Various modifications and applications may occur to those skilled in the art without departing from the true spirit and scope of the invention as defined by the appended claims.

What is claimed is:

1. A variable impedance current limiting device, comprising:

a housing defining a chamber therein;

a pair of spaced electrical terminals respectively located at opposite ends of said housing and disposed in communication with said chamber;

an electrically conductive fusible metal disposed in said chamber to provide an electrically conductive path between said terminals;

an insulating member disposed in said chamber between the opposite ends of said housing defining a flow passageway that provides communication between said terminals across said chamber, said flow passageway extending substantially through the center of said insulating member and the diameter of said flow passageway being approximately equal to the length of said flow passageway wherein with the occurrence of an overload current, vaporization of said fusible metal initially occurs in said flow passageway; and expansion means for buffering the pressure rise in said chamber when said fusible metal is vaporized.

2. A variable impedance current limiting device, comprising:

a housing defining a chamber therein;

a pair of spaced electrical terminals respectively located at opposite ends of said housing and disposed in communication with said chamber;

an electrically conductive fusible metal disposed in said chamber to provide an electrically conductive path between said terminals;

an insulating member disposed in said chamber between the opposite ends of said housing defining a flow passageway that provides communication between said terminals across said chamber, said flow passageway including a constricted portion having a cross-sectional area and length substantially less than that of the rest of said flow passageway and said constricted portion extending through the center of said insulating member wherein with the occurrence of an overload current, vaporization of said fusible metal initially occurs in said constricted portion and is primarily contained in said flow passageway; and expansion means for buffering the pressure rise in said chamber when said fusible metal is vaporized.

3. A variable impedance current limiting device, comprising:

a housing defining a chamber therein;

a pair of spaced electrical terminals respectively located at opposite ends of said housing and disposed in communication with said chamber;

an electrically conductive fusible metal disposed in said chamber to provide an electrically conductive path between said terminals;

an insulating member disposed in said chamber between the opposite ends of said housing to define with an interior wall of said housing a flow passageway that provides communication between said terminals across said chamber, said flow passageway including a constricted portion having a cross-sectional area and length substantially less than that of the rest of said flow passageway wherein with the occurrence of an overload current, vaporization of said fusible metal initially occurs in said constricted portion and is primarily contained in said flow passageway; and expansion means for buffering the pressure rise in said chamber when said fusible metal is vaporized.

4. The current limiting device of claim 3 wherein the ratio of the length of said constricted portion to that of the rest of said flow passageway is between about 0.02 and 0.05.

5. The current limiting device of claim 4 wherein the ratio of the cross-sectional area of said constricted portion to that of the rest of said flow passageway is between about 0.02 and 0.05.

6. The current limiting device of claim 3 wherein the ratio of the length of said constricted portion to the length of the rest of said flow passageway is approximately 0.03.

7. The current limiting device of claim 6 wherein the ratio of the cross-sectional area of said constricted portion to the cross-sectional area of the rest of said flow passageway is approximately 0.03.

8. The current limiting device of claim 3 wherein said housing includes fluid passageways for the flow of a cooling liquid therethrough to cool said fusible metal.

9. The current limiting device of claim 3 wherein said member and said housing are each constructed of a ceramic material.

10. The current limiting device of claim 3 wherein said expansion means includes a piston located at each of the opposite ends of said housing to be axially movable within a respective one of said terminals, and means disposed between said pistons and the interior face of said terminals to act against the movement of said piston toward the interior face of said terminal.

11. A variable impedance current limiting device, comprising:

a housing defining a chamber therein;

a pair of spaced terminals respectively located at opposite ends of said housing and disposed in communication with said chamber;

an electrically conductive fusible metal disposed in said chamber to provide an electrically conductive path between said terminals;

an insulating member disposed in said chamber between opposite ends of said housing and having an overall length less than said housing to define a flow passageway that provides communication between said terminals across said chamber, said flow passageway including a constricted portion extending through the center of said insulating member wherein the ratio of the cross-sectional area of said constricted portion to that of the rest of said flow passageway is between about 0.1 and 0.2 and the ratio of the length of said constructed portion to that of the rest of said flow passageway is between about 0.1 and 0.2; and means for buffering the pressure rise in said chamber when said fusible metal vaporizes.

12. The current limiting device of claim 11 wherein the ratio of the length of said constricted portion to the length of the rest of said flow passageway is approximately 0.15.

13. The current limiting device of claim 12 wherein the ratio of the cross-sectional area of said constricted portion to the cross-sectional area of the rest of said flow passageway is approximately 0.15.

14. A variable impedance current limiting device, comprising:

a housing having an insulating wall defining a chamber therein;

a pair of spaced electrical terminals respectively located at opposite ends of said housing and disposed in communication with said terminals;

a substantially cylindrical-shaped insulating member concentrically arranged and axially centered in said housing and having an overall length less than that of said housing to define a flow passageway substantially across the center of said housing to provide communication between said terminals through said chamber, said passageway including a constricted portion substantially through the center of said member wherein the ratio of the cross-sectional area of said constricted portion to that of the rest of said flow passageway is between about 0.1 and 0.2 and the ratio of the length of said constricted portion to that of the rest of said flow passageway is between about 0.1 and 0.2.

15. A method of limiting current in a variable impedance current limiting device, said device including a housing defining a chamber therein, a pair of spaced terminals located at opposite ends of said housing and disposed in communication with said chamber, and an electrically conductive fusible metal disposed in said chamber to provide an electrically conductive path between said terminals, comprising:

disposing an insulating member in said chamber between the opposite ends of said housing to define a flow passageway that provides communication between said terminals across said chamber;

extending said flow passageway through the center of said insulating member with the diameter of said flow passageway being approximately equal to the length of said flow passageway wherein with the occurrence of an overload current, vaporization of said fusible metal initially occurs in said flow passageway; and buffering the pressure rise in said chamber when said fusible metal is vaporized.

16. A method of limiting current in a variable impedance current limiting device, said device including a housing defining a chamber therein, a pair of spaced terminals located at opposite ends of said housing and disposed in communication with said chamber, and an electrically conductive fusible metal disposed in said chamber to provide an electrically conductive path between said terminals, comprising:

disposing an insulating member in said chamber between the opposite ends of said housing to define a flow passageway that provides communication between said terminals across said chamber;

providing in said flow passageway a constricted portion that extends through the center of said insulating member wherein the cross-sectional area of said constricted portion is between one-tenth and one-fifth that of said flow passageway and the length of said constricted portion is between one-tenth and one-fifth that of said flow passageway; and buffering the pressure rise in said chamber when said fusible metal is vaporized.

17. A method of limiting current in a variable impedance current limiting device, said device including a housing defining a chamber therein, a pair of spaced terminals located at opposite ends of said housing and disposed in communication with said chamber, and an electrically conductive fusible metal disposed in said chamber to provide an electrically conductive path between said terminals, comprising:

disposing an insulating member in said chamber between the opposite ends of said housing to define a flow passageway between the interior wall of said housing and said insulating member to provide communication between said terminals across said chamber;

providing in said flow passageway a constricted portion wherein the ratio of the cross-sectional area of said constricted portion to that of the rest of said flow passageway is between about 0.02 and 0.05, and the ratio of the length of said constricted portion to that of the rest of said flow passageway is between about 0.02 and 0.05; and buffering the pressure rise in said chamber when said fusible metal is vaporized.

* * * * *